US007926703B2

(12) United States Patent
Kleinsmith

(10) Patent No.: US 7,926,703 B2
(45) Date of Patent: Apr. 19, 2011

(54) CONSUMER PACKAGE HAVING A VIEWING ANGLE DEPENDENT APPEARANCE

(75) Inventor: Randy James Kleinsmith, Fairfield Township, OH (US)

(73) Assignee: The Procter & Gamble Company, Cinncinnati, OH (US)

( * ) Notice: Subject to any disclaimer, the term of this patent is extended or adjusted under 35 U.S.C. 154(b) by 0 days.

(21) Appl. No.: 12/699,263

(22) Filed: Feb. 3, 2010

(65) Prior Publication Data

US 2010/0133136 A1 Jun. 3, 2010

Related U.S. Application Data

(63) Continuation of application No. 12/264,544, filed on Nov. 4, 2008, now Pat. No. 7,717,268, which is a continuation of application No. 11/015,112, filed on Dec. 17, 2004, now Pat. No. 7,451,874.

(51) Int. Cl.
*B65D 25/54* (2006.01)
*B65D 73/00* (2006.01)

(52) U.S. Cl. ..... 229/162.6; 206/494; 206/459.5

(58) Field of Classification Search ..... 206/440, 206/441, 442, 494, 583, 459.5, 457, 459.1; 40/310, 312; 359/1, 3; 229/162.1, 162.6, 229/87.06

See application file for complete search history.

(56) References Cited

U.S. PATENT DOCUMENTS 2,305,890 A * 12/1942 Moore ..... 40/310
3,865,299 A 2/1975 Crabtree
3,944,072 A 3/1976 Budington et al.
4,013,168 A 3/1977 Bamburg et al.
4,063,679 A 12/1977 Henry
4,230,729 A 10/1980 Hoelzel, Jr. et al.
4,388,993 A 6/1983 Lavery
4,549,690 A 10/1985 Rosenburg
4,717,022 A 1/1988 Combs
4,773,539 A 9/1988 Nock
4,984,734 A 1/1991 Zion et al.
5,020,664 A 6/1991 Hughes et al.
5,071,062 A 12/1991 Bradley et al.
5,142,384 A * 8/1992 Wood et al. ..... 359/3
5,238,180 A 8/1993 Shimizu
5,259,550 A 11/1993 Kuchenbecker
5,462,171 A 10/1995 Moog et al.
5,464,148 A 11/1995 Schoch et al.
5,636,741 A * 6/1997 O'Keefe ..... 206/459.1
5,718,336 A * 2/1998 Haarlander ..... 206/542
5,725,099 A 3/1998 Ericson
5,871,144 A 2/1999 Anchor et al.
5,901,904 A 5/1999 Avot
5,937,554 A 8/1999 Haugk et al.

(Continued)

FOREIGN PATENT DOCUMENTS

EP 0 824 476 B1 8/1999

(Continued)

*Primary Examiner* — Luan K Bui
(74) *Attorney, Agent, or Firm* — Peter D. Meyer

(57) ABSTRACT

A consumer package flat for forming a package is disclosed. The consumer package flat comprises a plurality of panels. At least one of the panels comprises a compound image attached thereto. The compound image is observable through an opening disposed within at least one of the panels. The compound image has a viewing angle dependent appearance so that at least two image attributes selected from the group consisting of flip, motion, depth of field, and zoom are perceived according to an angle at which the compound image is observed.

11 Claims, 3 Drawing Sheets

U.S. PATENT DOCUMENTS

| | | | | |
|---|---|---|---|---|
| 5,953,170 | A | 9/1999 | Glancy | |
| 5,988,389 | A | 11/1999 | Buscema | |
| 6,042,022 | A | 3/2000 | Rogozinski et al. | |
| D422,497 | S * | 4/2000 | Huntley | D9/627 |
| 6,070,724 | A * | 6/2000 | McCool | 206/352 |
| 6,270,451 | B1 | 8/2001 | Palm et al. | |
| 6,371,296 | B1 * | 4/2002 | Rumbough | 206/494 |
| 6,443,357 | B1 | 9/2002 | Marbe et al. | |
| 2002/0029501 | A1 | 3/2002 | Braun | |

FOREIGN PATENT DOCUMENTS

| | | | |
|---|---|---|---|
| EP | 0 950 617 | A2 | 10/1999 |
| EP | 1 164 083 | A1 | 12/2001 |
| EP | 1 216 926 | A1 | 6/2002 |
| WO | WO 00/15510 | A1 | 3/2000 |
| WO | WO 01/17863 | A2 | 3/2001 |
| WO | WO 02/12104 | A1 | 2/2002 |

* cited by examiner

CONSUMER PACKAGE HAVING A VIEWING ANGLE DEPENDENT APPEARANCE

CROSS-REFERENCE TO RELATED APPLICATIONS

This application is a continuation of application Ser. No. 12/264,544, filed Nov. 4, 2008, now U.S. Pat. No. 7,717,268, which is a continuation of application Ser. No. 11/015,112, filed Dec. 17, 2004, now U.S. Pat. No. 7,451,874.

FIELD OF THE INVENTION

The present invention relates to packages for consumer products. The invention relates particularly to consumer product packages having a decorative appearance that is dependent upon the viewing angle of an observer.

BACKGROUND OF THE INVENTION

Decorative consumer packages are well known in the art. Consumer packages may comprise a decorative appearance for marketing purposes or as to enhance the function of the package in use.

As a marketing tool, the exterior surfaces of a consumer package may be decorated to attract the attention of a potential shopper. The decorative appearance may be used to inform the shopper as to the nature of the product and the use of the product contained by the package. Other marketing information such as pricing or promotional offers may also be communicated by using a decorative appearance.

The use of lenticular and holographic images as at least a portion of the decorative appearance of a package is also well known. Such images may be used to provide an enhanced product appearance. An enhanced product appearance may be particularly desirable for a package that may be displayed by a consumer over the useful life of the package contents. Facial tissue packages may be displayed in the home or workplace of a consumer over the course of use of the plurality of tissues contained in the package.

The appearance of a package has been enhanced using images that change appearance as the viewing angle of the observer changes. Images that provide a perception of motion and that change dramatically from a first image to a second image have been used to attempt to increase acquiring the attention of a potential product purchaser.

SUMMARY OF THE INVENTION

The present disclosure is directed toward a consumer package flat for forming a package. The consumer package flat comprises a plurality of panels. At least one of the panels comprises a compound image attached thereto. The compound image is observable through an opening disposed within the at least one panels. The compound image has a viewing angle dependent appearance so that at least two image attributes selected from the group consisting of flip, motion, depth of field, and zoom are perceived according to an angle at which the compound image is observed.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

Figure 1:
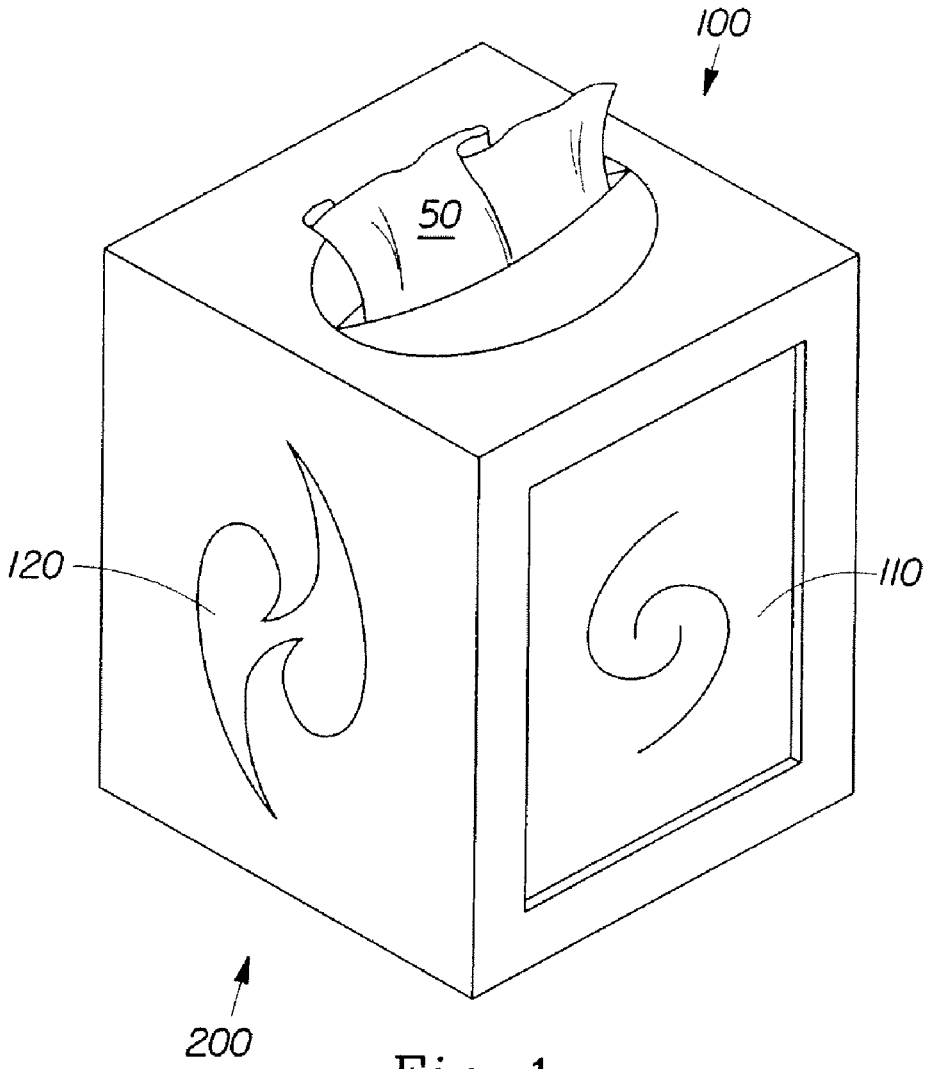
FIG. 1 illustrates a schematic isometric view of a consumer package according to one embodiment of the invention.

According to FIG. 1, consumer package 100 comprises a decorative image 110. The decorative image 110 comprises a viewing angle dependent image or compound image. The decorative image 110 provides a perception of at least two attributes selected from the group consisting of flip, morph, motion, zoom, and depth of field as the viewing angle of an observer changes with regard to the decorative image.

Flip refers to a perceived substitution of a second image for a first image as the viewing angle of the decorative image changes. The images may be visually related or may be visually unrelated. Flipping may be used in association with two or more images that are visually unrelated but are related in terms of the subject matter. As a non-limiting example, an image of a caterpillar may flip to an image of a butterfly as the viewing angle changes.

Morphing refers to a perceived substitution of images having similar shapes and color densities but differing specific content.

Motion refers to the perception that a viewed object moves as the observers viewing angle of the image changes. Non-limiting examples of motion include, without being limiting, the sweep of the beam of a lighthouse following the viewing angle of the observer, a bird in flight, a butterfly flapping its wings, a anthropomorphic character acting out a sequence of movements, a vehicle moving across the image and combinations of these.

Zoom refers to a shift in position of at least a portion of the image from the background of the image to the foreground of the image. The zoomed portion may appear to enlarge as the shift from background to foreground is achieved.

Depth of field refers to a perception of three-dimensionality of the image wherein respective image elements are perceived to have a front to back spatial appearance. The image may be perceived to comprise distinct foreground elements and other distinct middle ground elements. The image may be perceived to comprise background elements as well.

These attributes may be perceived in combination. Motion and zoom, depth of field and motion, zoom and depth of field are non-limiting examples of possible combinations of image attributes. As non-limiting examples of such combinations, an image element may be perceived as moving from the back of the image to the front of the image. An image element may be perceived as moving in the middle ground of the image behind foreground elements and in front of background elements. An image element may be perceived as moving from a first background scene to a second background scene.

In one embodiment the compound image 110 may be provided for incorporation into the package 100 as an adhesive backed lenticular label. Such a label may be applied to either a package flat or an erected package using label application means known in the art. In another embodiment the compound image is joined to the package using a separately applied adhesive. In another embodiment the compound image may be produced directly upon the package flat. Compound images of the type herein described may be acquired from Wallace Post Printing, of West Bend, Wis.

The compound image 110 comprises a portion of the decorative appearance of the consumer product package 100. The package 100 may additionally comprise indicia 120. The indicia 120 may relate to the type of consumer product 50, to an attribute of the consumer product 50, to a brand name related to the consumer product 50 and combinations of these. The indicia 120 may be printed, embossed or otherwise imparted to the package 100 as is known in the art.

The subject matter of the indicia 120 may be related to the subject matter content of the compound image 120. The indicia 120 may present an element of the compound image 110 in a simplified form. In one embodiment the indicia 120 may present in a fixed presentation an element perceived to move in the compound image 110. In another embodiment the indicia 120 may present text that relates to one or more elements of the compound image 110. In such an embodiment, the text of the indicia 120 may augment the perception associated with the compound image 110 and may provide additional explanation to a message conveyed by the compound image 110. The indicia 120 may present elements generally associated with one or more elements of the compound image 110. As a non-limiting example, the compound image 110 may comprise a depiction of a character from popular culture in motion. The indicia 120 of this embodiment may comprise items associated with the environment or activities of the character.

Figure 2:
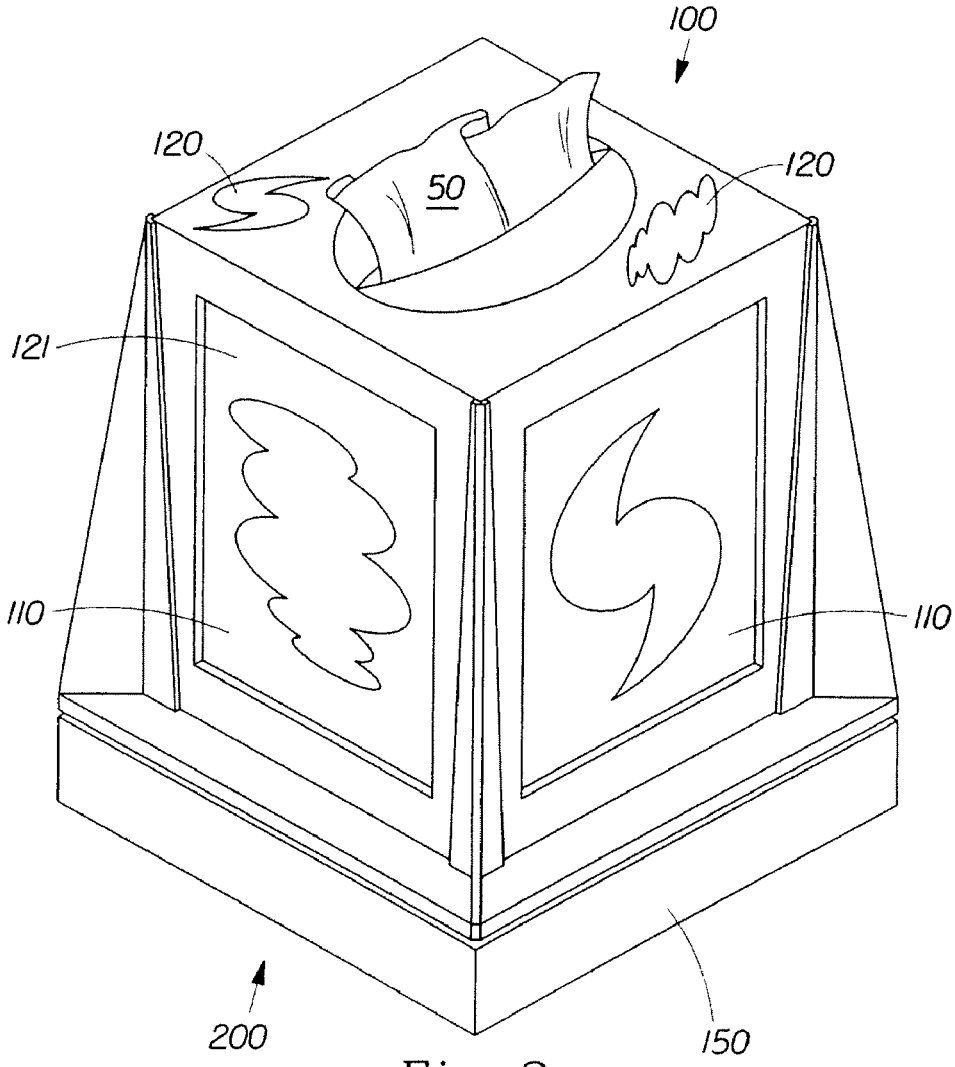
FIG. 2 illustrates a schematic isometric view of a kit according to another embodiment of the invention.

In one embodiment illustrated in FIG. 2 the package 100 may comprise multiple compound images 110. The multiple images 110 may be substantially similar such that the package 100 appears to comprise a plurality of a single image. In another embodiment, the multiple images may comprise a set of compound images 110 that relate to each other and provide a series of related perceptions. In another embodiment, the multiple compound images 110 may provide a set of unrelated perceptions. In this embodiment as a non-limiting example, a first compound image 110 may provide a decorative perception to an observer to enhance the decorative nature of the package 100. A second compound image 121 may provide a perception related to an attribute or use of the consumer product.

In one embodiment the package 100 may be provided as a container for use by the consumer. In another embodiment, the package 100 may be provided as packaging in a kit 200 comprising a consumer product 50 in addition to the package 100. In one embodiment a single consumer product 50 may be provided in conjunction with the package 100. In another embodiment a plurality of a single consumer product 50 may be provided. In another embodiment a combination of differing consumer products 50 may be provided. The package 100 may at least partially enclose the provided consumer product 50 whether a single product or a plurality of product is provided.

Any packaged consumer product 50 may be provided in conjunction with the package 100. Exemplary consumer products 50 include, without being limiting, food products, pet products, personal care products, cleaning products, paper products including paper toweling, facial tissue and bath tissue, automotive products, baby care products, feminine care products, health care products and combinations of these.

As illustrated in FIG. 2 the kit 200 may further comprise a package holder 150 of a decorative nature. The decorative nature of the package holder 150 may be related to the compound image 110 or set of images provided by the consumer product package 100. The holder 150 may enhance the dispensing of the consumer product 50 from the package 100 by stabilizing the package 100 against the forces required to dispense the product 50 from the package 100.

In one embodiment the package holder 150 may be adapted to cooperate with the package 100 to enable the efficient dispensing of the consumer product 50 from the package 100. The holder 150 may be further adapted to move the package 100 as the product 50 is dispensed such that the viewing angle of the compound image 110 is altered by the dispensing of the product 50. As a non-limiting example, the holder 150 may be adapted such that the action of dispensing one or more individual consumer products 50 from the package 100 causes the package 100 to rotate about at least one axis thereby altering an observer's viewing angle with respect to the compound image 110. The rotation may be continuously in one direction such that each successive dispensing causes a further rotation of the package in a single direction. The extent of the rotation associated with each individual dispensing action may be as small as about 5 degrees or as large as 360 degrees depending upon the desired effect associated with the rotation.

The rotation may be a precession about a center. In one embodiment each dispensing action may cause motion in one direction from a center line followed by a reverse motion upon the next dispensing action. In another embodiment, each dispensing action may cause a reciprocating precession about a center axis. The extent of the precession may be about 5 to about 10 degrees total motion to effect a change in the perception of the compound image 110. The extent of the precession may be more than about 10 degrees enhance the perception of motion related to the dispensing action. The motion of the package 100 and attendant image change may be used to encourage usage of the consumer product 50.

The motion of the package 100 in cooperation with the holder 150 may be a lateral or vertical motion associated with one or more axes of the package 100. The motion of the package in cooperation with the holder 150 may comprise a rotary motion about a package 100 axes. The motion of the package 100 may comprise a combination of lateral, vertical and rotary motions.

As a non-limiting example the holder 150 may be adapted to sense an upward motion of the package 100 as a consumer product 50 is dispensed from the package. The holder may comprise a sensor. The sensor may be a mechanical, piezoelectric, optical, infrared, or ultrasonic sensor and may provide an indication that the product 50 is being dispensed. The holder 150 may be adapted to rotate the package 100 in response to the indication that the product 50 is being dispensed. The holder 150 may comprise a package platform and a spring mechanism such that the action of placing the package upon the platform and moving the package 100 into the holder 150 compresses the spring. The energy stored in the compressed spring may subsequently be used to rotate the package as the dispensing of product 50 is indicated.

In another embodiment the holder 150 may incorporate an electric motor and may move the package 100 in response to an indication that product 50 is being dispensed or is about to be dispensed. The indication may be derived from any means known in the art for providing such an indication. The motion of the package away from a spring loaded switch may trigger the motion of the package 100 by energizing the electric motor.

Figure 3:
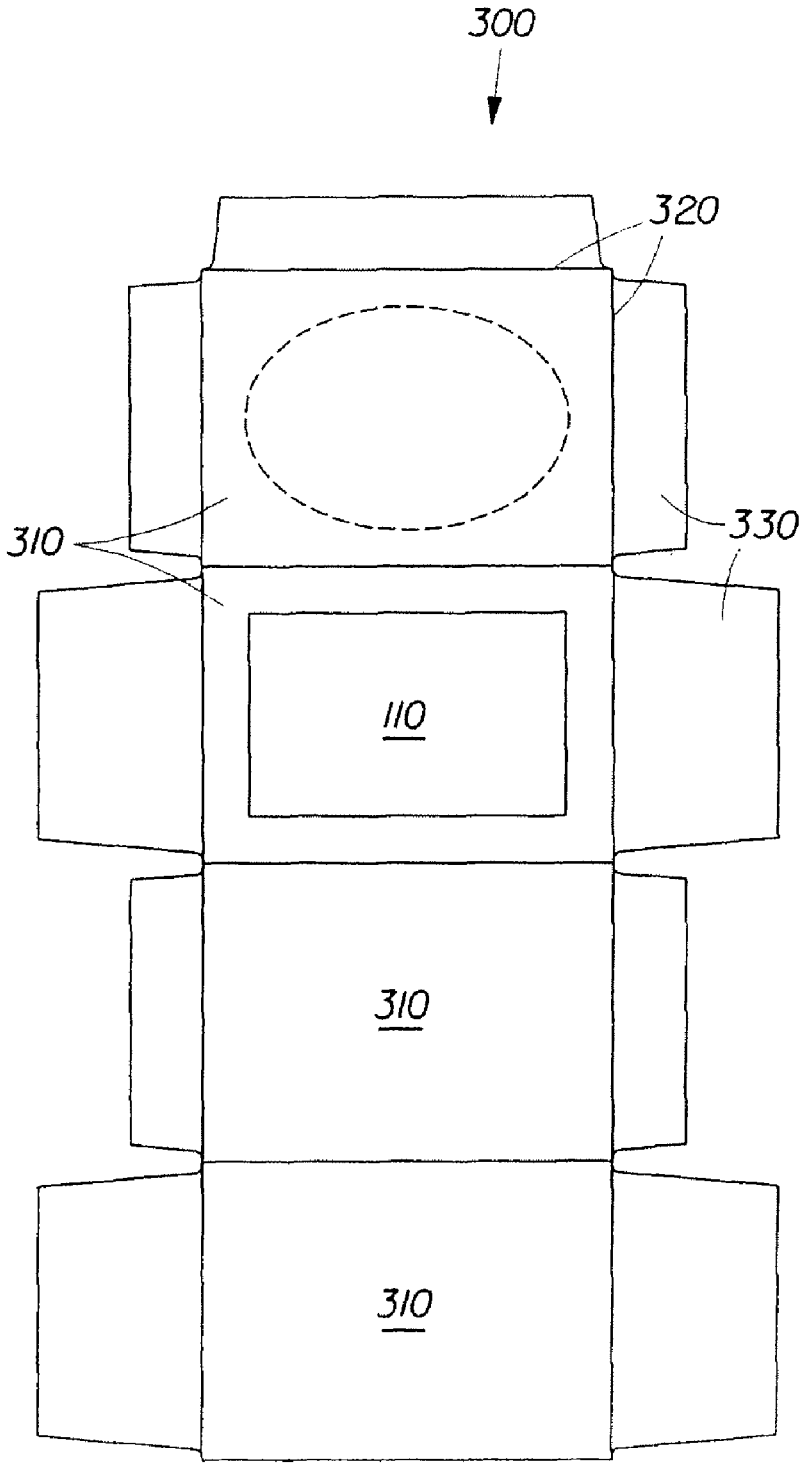
FIG. 3 illustrates a package flat adapted to erect into a consumer package according to one embodiment of the invention.

The package 100 may be erected from a package flat 300 as is known in the art. As illustrated in FIG. 3 a package flat 300 may comprise a plurality of panels 310. The panels 310 may be separated by score lines 320 to facilitate the erection of the flat 300 into a package 100. The flat 300 may further comprise tabs 330 adjacent to one or more panels 310 and separated by score lines 320. The tabs 330 may provide surfaces for the application of an adhesive and may be folded along the score lines 320 to facilitate the shaping of the package 100.

The flat 300 may be comprised of any packaging material known in the art. Exemplary package materials include, without being limiting, chipboard, corrugated paperboard, metal foils, Mylar™ films, plastic films including without limitation polyethylene, polypropylene, polyester, nylon, and laminated films comprising combinations of packaging materials as are known in the art.

The flat 300 may be erected and formed into the package 100 using packaging equipment as is known in the art. The flat 300 may be folded and bonded along at least some of the package seams as a first step. The bonded flat may be subsequently erected, filled with the desired consumer product and bonded along the remaining package seams.

The nature of the bonding of the seams of the package 100 may be determined according to the material of the flat 300. The method of seam bonding may comprise any bonding method as is known in the art. As non-limiting examples chipboard, paper and corrugated flats may be bonded using EVA hot melt glue or cold gluing as is known in the art. Films may be bonded using ultrasonic welding or adhesives. Laminated films may comprise polymeric layers to facilitate the bonding of the flat into the intermediate and/or final package.

One or more compound images 110 may be fixedly or releasably attached to the flat 300. The compound image may be attached to the flat 300 as an adhesive backed label or sticker as is known in the art. The nature of the adhesive may determine if the image 110 is fixedly or releasably attached. The image 110 may be releasably attached to enable the removal of the image as desired by the consumer.

In one embodiment, a set of related images 110 may be provided via separate packages 100. Providing releasable images 110 may enable and encourage consumers to collect the images 110 and may encourage additional purchases of the consumer package 100.

In one embodiment illustrated in FIG. 3, a compound image 110 is framed by an open panel 310 such that the compound image 110 is recessed from the outer surface of the package 100 after the flat 300 has been erected into a package 100. Recessing the image 110 from the outermost surface of the package 100 may provide protection from incidental abrasive damage to the image 110 as the package 100 is handled prior to, during, and after the formation of the package 100.

Marketing the Package:

Unique marketing methods may be provided by the consumer products package 100 according to the invention. A series of related compound images 110 may be presented to the consumer with each image attached to a distinct package 100 requiring the purchase of multiple packages 100 to acquire each of the images 110. The set of images 110 may be related as individual elements of a series of images 110. In another embodiment, the set of images may have individual content and may further be combinable into a distinct collective image after the acquisition of multiple images 110. Such a set of related images 110 may provide an opportunity for a retail display to provide a shopper with an indication as to the composite image formed from the combination of individual images 110.

The compound image 110 may be used to educate a consumer as to the proper use of the consumer product 50. The compound image 110 may be used to encourage consumers to approach the package 100 and to remove the product 50 from the package 100 by illustrating motion that is related to the removal of the product 50 from the package 100. As a non-limiting example the compound image may illustrate an upward motion on a package wherein the consumer product is removed by an upward motion. The compound image 110 may be related to a product attribute considered to be desired by the consumer. As a non-limiting example, an image may evoke the idea of softness in association with a product having softness as a product category desired attribute.

The compound image 110 may be selected and configured to encourage the use of the consumer product 50. As an example a compound image 110 may change in appearance depending upon the proximity of the observer to the package 100. In one embodiment the compound image 110 may change as the observer approaches the package 100. This change may reinforce the behavior of approaching the package 100. A second image 110 may encourage withdrawal of the product 50 from the package 100 for subsequent use. This type of image could be used in conjunction with the package 100-holder 150 combination described above wherein a first compound image 110 changes as the combination is approached and a second compound image 110 changes as the product 50 is dispensed from the package 100 by cooperation between the package 100 and the holder 150.

In one embodiment a cartoon character may entice an approach to the package 100-holder 150 combination by way of a compound image 110 providing a perception of motion on the part of the character as an observer approaches the package 100 holder 150 combination. A second compound image 110 may feature further activity by the same character or a related character as an individual product 50 is withdrawn from the package 100 due to a twisting of the package 100 by cooperation of the package 100 and holder 150 as the product is withdrawn. In this manner an observer may be enticed to approach the package 100, withdraw the product 50 and subsequently use the product 50.

In one embodiment, the actions of the characters featured in the compound images 110 may be used to illustrate the use of the product 50 or to imply the use of the product 50 by the character or characters. As an example of such an embodiment, a tub of wet wipes intended for use by a toddler as an aid to toilet training may feature a set of compound images 110. A first image disposed upon the side of the tub may reveal a character related to the brand name of the wet wipes as the toddler approaches the tub. A second compound image disposed upon the upper surface of the tub may provide an illustration of the intended use of the wipes by the stylized actions of the same character or the actions of a related character.

Example 1

A facial tissue package may comprise a cardboard flat having four main panels separated by score lines. One of the main panels may comprise a perforated section defining a tear out panel and an orifice suitable for dispensing facial tissue. Another main panel may comprise an opening. A compound image may be fixedly attached to an image panel. The image panel may be fixedly attached to the flat such that the opening frames the compound image. The compound image may be recessed from the outer surface of the flat by the thickness of the flat. The flat may also comprise two pairs of minor panels configured to be joined to form two side panels, also separated from main panels by score lines. The flat may also comprise four tab panels configured to be folded behind the side panels to form an erect carton. The flat may be erected into a carton and at least partially filled with a plurality of facial tissues. The decorative elements of the compound image provide the perception of a butterfly moving behind a fore ground of flowers. Other surfaces of the flat carry simple images of the butterfly and the flowers that comprise the compound image.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A consumer package flat for forming a package, said consumer package flat comprising a plurality of interconnected panels, each of said panels having an internal and an external surface, at least one of said panels having an opening disposed thereon and a compound image attached to said internal surface thereof so that when said consumer package flat is assembled to form said package said compound image is observable through said opening and wherein said compound image further has a viewing angle dependent appearance such that at least two image attributes selected from the group consisting of flip, motion, depth of field, and zoom are perceived according to an angle at which said compound image is observed.

2. The consumer package flat according to claim 1 wherein said depth of field and said motion are perceived according to changes in the angle at which the compound image is observed.

3. The consumer package flat according to claim 1 wherein said motion and said zoom are perceived according to the angle at which the compound image is observed.

4. The consumer package flat according to claim 1 wherein said zoom and said depth of field are perceived according to the angle at which the compound image is observed.

5. The consumer package flat according to claim 1 further comprising indicia where content of the compound image is related to the indicia.

6. The consumer package flat according to claim 1 further comprising multiple compound images.

7. The consumer package flat according to claim 1 further comprising a second compound image disposed upon a second of said at least one of said panels, said second compound image being observable through an opening disposed within said second of said at least one of said panels.

8. The consumer package flat according to claim 1 wherein said compound image is releasably attached to said at least one of said panels.

9. The consumer package flat according to claim 1 wherein said compound image is recessed relative to said opening disposed within said at least one of said panels.

10. The consumer package flat according to claim 1 wherein each of said plurality of panels is separated from an adjacent panel by a score line.

11. The consumer package flat according to claim 1 wherein distal edges of said consumer package flat are bondable.

* * * * *